United States Patent [19]

Slomma

[11] 4,444,136

[45] Apr. 24, 1984

[54] DEVICE FOR INTERRUPTING A NEEDLE BAR DRIVE

[75] Inventor: Heinz-Georg Slomma, Viersen, Fed. Rep. of Germany

[73] Assignee: Maschinenfabrik Carl Zangs Aktiengesellschaft, Krefeld, Fed. Rep. of Germany

[21] Appl. No.: 395,900

[22] Filed: Jul. 7, 1982

[30] Foreign Application Priority Data

Jul. 15, 1981 [DE] Fed. Rep. of Germany ... 8120717[U]

[51] Int. Cl.[3] ..... D05B 55/16

[52] U.S. Cl. ..... 112/221; 112/98

[58] Field of Search ..... 112/221, 83, 84, 98

[56] References Cited

U.S. PATENT DOCUMENTS

| | | | |
|---|---|---|---|
| 3,575,121 | 4/1971 | Berube | 112/221 |
| 3,872,809 | 3/1975 | Adams et al. | 112/221 |
| 4,054,098 | 10/1977 | Hoever et al. | 112/221 X |
| 4,254,721 | 3/1981 | Teetz et al. | 112/221 |
| 4,289,086 | 9/1981 | Bolldort et al. | 112/221 |

*Primary Examiner*—Werner H. Schroeder

*Assistant Examiner*—Andrew M. Falik

*Attorney, Agent, or Firm*—Martin A. Farber

[57] ABSTRACT

A device for temporarily interrupting the movement of the embroidery needle on an automatically controlled embroidery or sewing machine has at least one needle driven by a connecting rod and a crank from a drive shaft. On this needle bar there is fastened a driver which can be coupled via a shift pawl developed as double-armed lever with a drive carriage which is pivotally connected to the connecting rod. While one arm of said lever cooperates with a catch developed on the drive carriage, another arm of the lever cooperates with a controllable holding pawl by which the needle bar can be held fast in an upper dead-center position with simultaneous disconnection from the drive carriage. In order to relieve the actuating element of the holding pawl from forces of the shift pawl and be able to transfer the holding pawl within a very short time from an active position into a disengaged position, the holding pawl is held in a form-interlocked manner against the forces of the shift pawl and can be moved out of the plane of motion of the shift pawl. Such movement can take place out of the plane of motion of the shift pawl.

17 Claims, 6 Drawing Figures

DEVICE FOR INTERRUPTING A NEEDLE BAR DRIVE

The present invention relates to a device for temporarily interrupting movement of the embroidery needle on automatically controlled embroidery or sewing machines having at least one needle bar adapted to be driven by a connecting rod and a crank from a drive shaft, on which needle bar there is fastened a driver which can be coupled by a shift pawl formed as a double-armed lever with a drive carriage pivotally connected to the connecting rod. One arm of which lever cooperates with a catch developed on the drive carriage while its other arm cooperates with a controllable holding pawl by which the needle bar can be held fast in an upper dead-center position with simultaneous disconnection from the drive carriage.

One device for temporarily interrupting the movement of the embroidery needle on automatically controlled embroidery or sewing machines of the above-mentioned type is known from West German Pat. No. 2,749,700 corresponding to U.S. Pat. No. 4,254,721. In that construction, the holding pawl is swung between two end positions around an axis extending parallel to the swivel axis of the shift pawl by an actuating element developed as a switch element. The holding pawl, in one end position, cooperates with the upper arm of the shift pawl and holds said shift pawl fast in the upper dead-center position after a swinging motion for disconnecting the needle bar from the needle-bar drive, so that the movement of the embroidery needle is interrupted.

This known construction has various disadvantages. For example in order to obtain the two end positions of the holding pawl the actuating member must carry out a relatively large stroke so that only large magnets can be used. Furthermore, the actuating element must apply large holding forces since it must act against the return spring of the double-armed shift pawl. For this reason also a relatively large magnet must be used as the actuating element. This is a decided disadvantage since not only must expensive magnets be used but relatively long shift times must also be tolerated, which limits the operating speed of the device.

The object of the invention, proceeding from the device known from West German Pat. No. 2,749,700, is to shorten the required shift times for the device for the automatic interruption of the embroidery-needle motion while at the same time simplifying the construction and decreasing its cost.

This goal is achieved by the invention through provision of the holding pawl held in a form interlocked manner against the forces of the shift pawl and movable out of the plane of motion of the shift pawl.

Due to the form interlocked holding of the holding pawl against the forces exerted on it by the shift pawl, the use of simpler actuating elements becomes possible since the actuating elements have to take up the forces exerted on the holding pawl by the shift pawl. The holding pawl is not swingable within the plane of movement of the shift pawl around an axis extending parallel to the swivel axis of the shift pawl. Rather, in accordance with the invention, the holding pawl is moved out of the plane of movement of the shift pawl. Such movement is carried out by the holding pawl between the shift and locking positions of the holding pawl. The release position of the holding pawl is reduced to a distance which lies merely within the order of magnitude of the width of the cooperating surfaces between the holding pawl and the shift pawl. Under this arrangement it is possible to use small and thus inexpensive actuating elements. Thus in addition to a considerable simplification in construction and a simultaneous improvement in operation substantially shorter shift times are required in order to move the holding pawl between its non-engaged position and its active position. While the known construction permitted speeds of rotation of the embroidery or sewing machine of 600 to at most 750 revolutions per minute, a reliable effect is still obtained at speeds of 1500 rpm with the development in accordance with the invention.

In accordance with another feature of the invention, the holding pawl can be guided by a linear guide at right angles to the plane of movement of the shift pawl and be displaceable by an actuating element. With this construction it is sufficient to displace the holding pawl by an amount equal to its width in order for the holding pawl to be placed out of the range of action of the switch pawl.

In accordance with another feature of the invention, the holding pawl can be swung by an actuating element around an axis lying parallel to the plane of movement of the shift pawl. This further development of the concept of the invention produces a transfer of the holding pawl between the release position and the active position by a very slight swing corresponding approximately to the width of the holding pawl. The axis of swing of the holding pawl represents its form interlocked support with respect to the forces of the shift pawl.

In both developments of the invention it is possible to employ as the actuating element a single-stroke magnet (solenoid) which acts against a restoring spring, which solenoid is particularly small and economical and has very short switch times. With the above and other objects and advantages in view, the present invention will become more clearly understood in connection with the detailed description of preferred embodiments, when considered with the accompanying drawings, of which:

Figure 1:
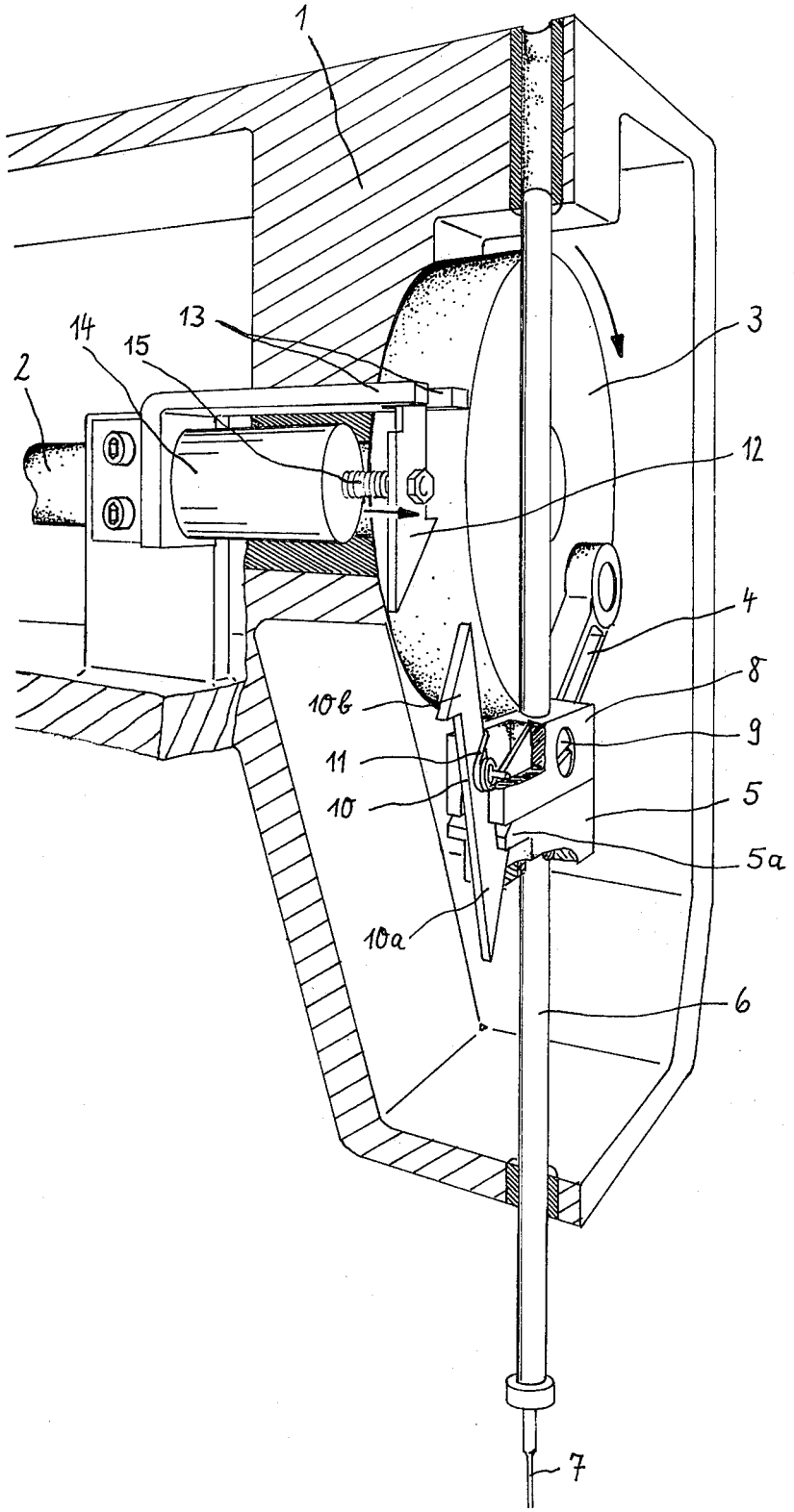
FIG. 1 shows a first embodiment of the invention with the holding pawl displaceable parallel to the plane of movement of the shift pawl, the holding pawl being shown in a non-engaged position.

In both embodiments there can be noted in perspective the front part of the housing 1 of an embroidery-machine head in which the front end of a drive shaft 2 is supported. On the front end of this drive shaft 2, a connecting rod 4 is pivoted to a crank disk 3, the other end of the connecting rod being pivoted to a drive carriage 5. The drive carriage 5 is guided for movement on a needle bar 6 which in turn is mounted for longitudinal displacement in the housing 1 and bears a needle 7 at its lower end.

The coupling of the drive carriage 5 to the needle bar 6 is effected by a driver 8 which is arranged on the needle bar 6 and fastened in a non-displaceable manner on the needle bar 6 by a screw 9. The driver 8 carries a shift pawl 10 which is developed as a double-armed lever and is acted on by a pawl spring 11. The lower arm 10*a* of the shift pawl 10 cooperates with a catch 5*a* of the drive carriage 5 so that the drive carriage 5 can be coupled hook-like via the shift pawl 10 with the driver 8 in order to drive the needle bar 6, as shown, for example, in FIG. 1.

In order to disengage the drive carriage 5 from the driver 8 of the needle bar 6 and be able to fix the needle bar in the upper dead-center position, the upper arm 10*b* of the shift pawl 10 cooperates with a holding pawl 12. The holding pawl 12 is held in a form interlocked manner against the forces exerted on it by the shift pawl 10 and in particular against the forces of the pawl spring 11. The holding pawl 12 can be moved from an active position which lies in the plane of motion of the shift pawl 10 into a disengaged position which lies outside the plane of motion of the shift pawl 10. The two embodiments shown in FIGS. 1 to 4 and FIGS. 5 and 6 respectively differ from each other in the nature of the form interlocked holding of the holding pawl 10 and its movement between the active position and the disengaged position.

In the first embodiment, shown in FIGS. 1 to 4, the holding pawl 12 is guided by a linear guide 13 transverse to the plane of motion of the shift pawl 10. The holding pawl 12 is brought from its active position located in the plane of movement of the shift pawl 10 into a disengaged position by displacement at right angles to the plane of motion along the linear guide 13 by an actuating element 14 which is developed as a single stroke magnet which acts against the force exerted by a return spring 15.

Figure 2:
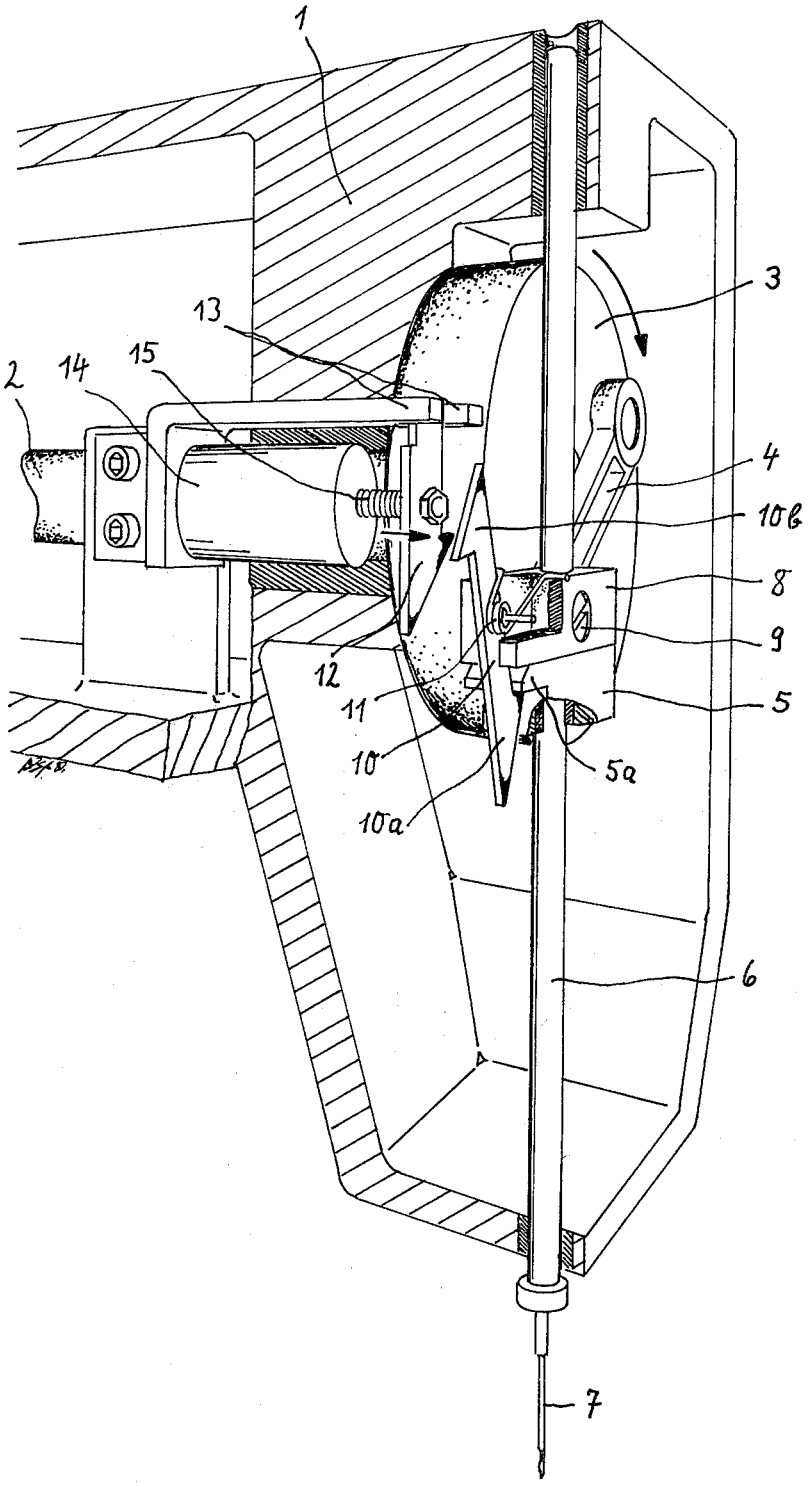
FIG. 2 shows the embodiment of FIG. 1 with the crank in a different position.

FIG. 1 shows a coupling of the driver 8 with the drive carriage 5 via the shift pawl 10 so that upon the rotation of the crank disk 3 indicated by an arrow the needle bar 6 is driven back and forth. The holding pawl 12 is in its disengaged position, as shown by the compressed state of the return spring 15. In this position of the holding pawl 12, which is also shown in FIG. 2, the holding pawl 12 is outside the plane of motion of the shift pawl 10. Thus, as shown in FIG. 2, the shift pawl 10 is moved past the holding pawl 12, which is moved by the actuating element 14 along the linear guide 13, when the driver 8 together with the shift pawl 10 has reached the upper dead-center position shown in FIG. 2. In this position of the holding pawl 12 the needle bar 6 accordingly remains connected to its drive.

Figure 3:
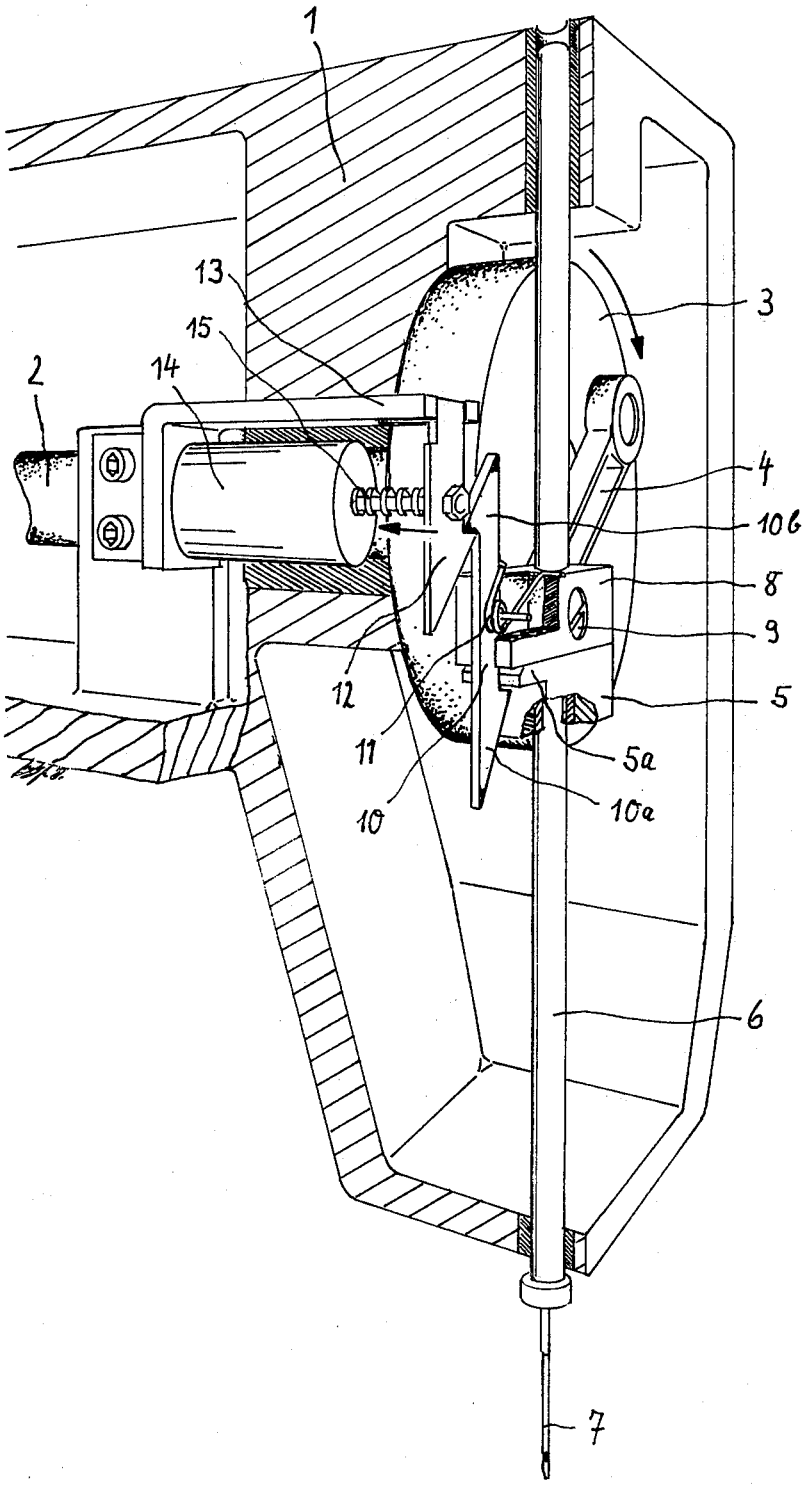
FIG. 3 shows the embodiment of FIGS. 1 and 2 with the shift pawl in an active position during the coupling process.
Figure 4:
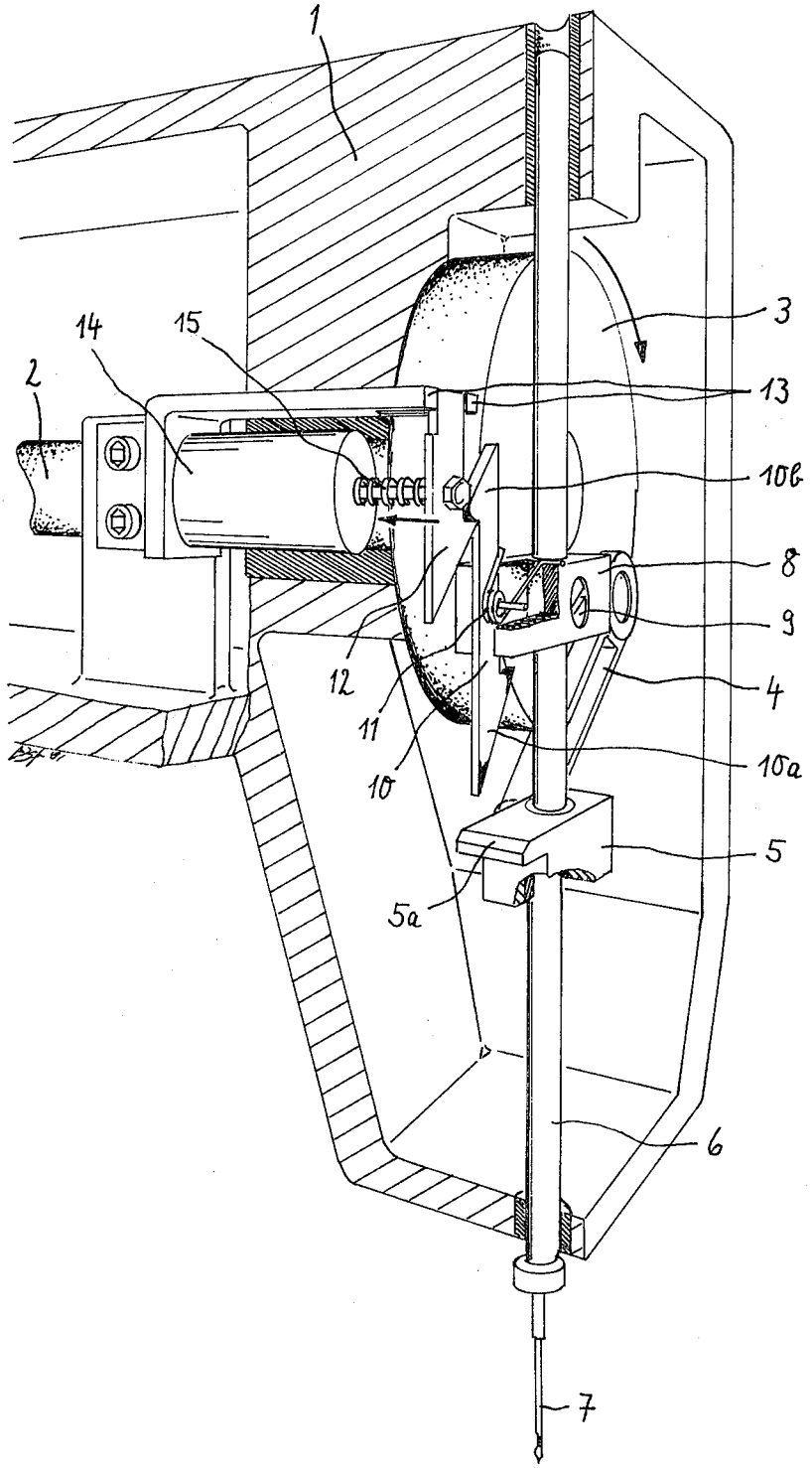
FIG. 4 is another view thereof with the needle bar disconnected from the drive and held in an upper dead-center position by the holding pawl.

In order to interrupt the movement of the needle, the holding force of the actuating element 14 is released, as shown in FIG. 3, so that the return spring 15 displaces the holding pawl 12 along the linear guide 13 into its active position, which lies within the plane of motion of the shift pawl 10. In this position, the upper arm 10*b* of the shift pawl 10 strikes the holding pawl upon its movement into the upper dead-center position. The shift pawl 10 is swung, to cause the lower arm 10*a* to release the notch 5*a* of the drive carriage 5 and to enable the upper arm 10*b* to be held fast against the holding pawl 12. In this manner the needle bar 6 is held fast in the upper dead-center position via the driver 8, the shift pawl 10 and the holding pawl 12, while the drive carriage 5, which is displaceable on the needle bar 6, is moved freely back and forth without connection with the driver 8.

FIGS. 1 to 4 show that the holding pawl 12 is held in form interlocked manner by the linear guide 13 so that the forces exerted by the shift pawl 10 on the holding pawl 12 can be counteracted by holding forces from the housing 1 in simple fashion. On the other hand, FIGS. 1 to 4 show that a slight movement of the holding pawl 12 by the actuating element 14 is sufficient to push the holding pawl 12 between the active position and the disengaged position. The path of displacement is on the order of magnitude of the thickness of the holding pawl 12.

Figure 5:
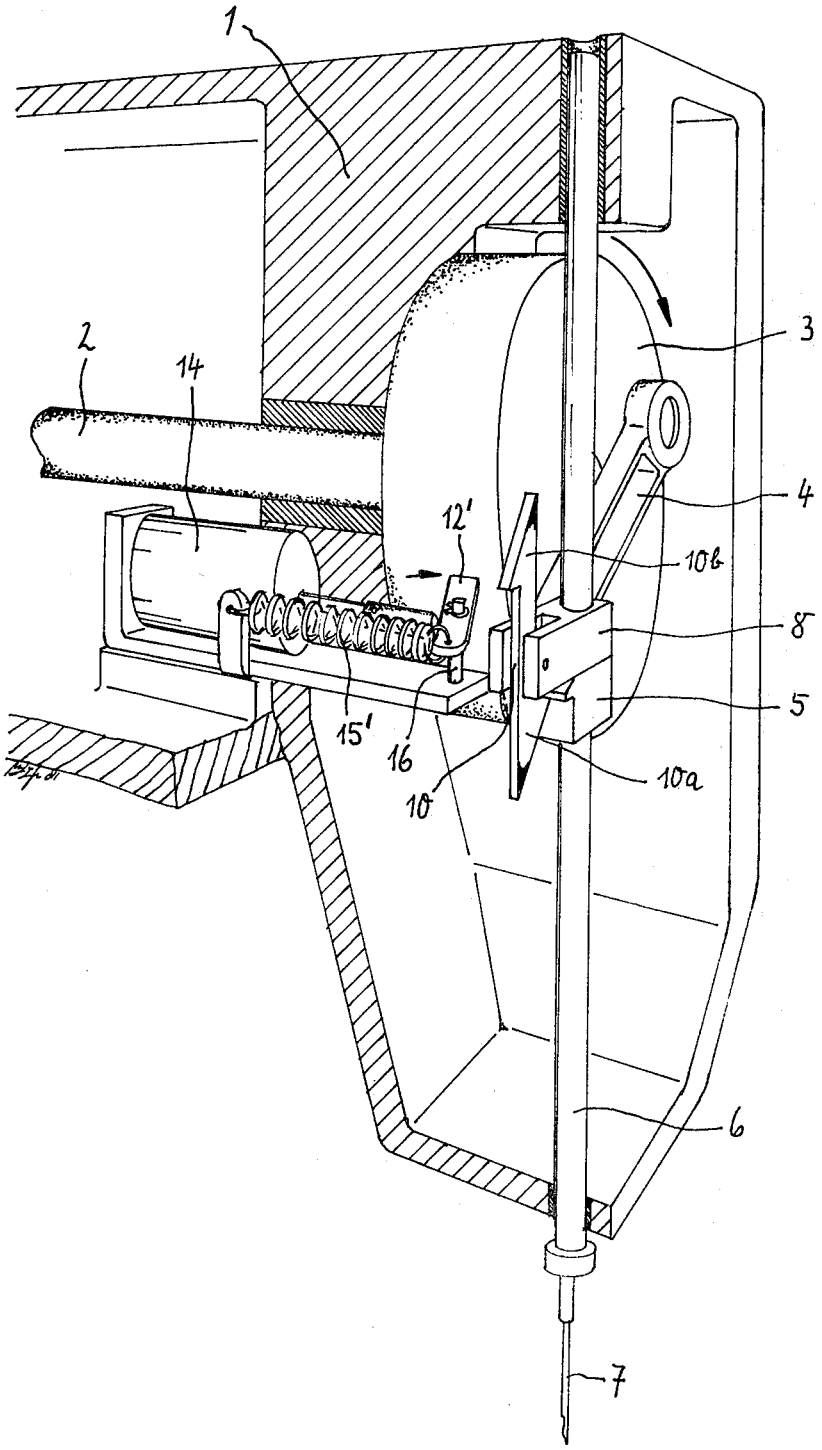
FIG. 5 shows a second embodiment of the invention with the swingable holding pawl in the non-engaged position.
Figure 6:
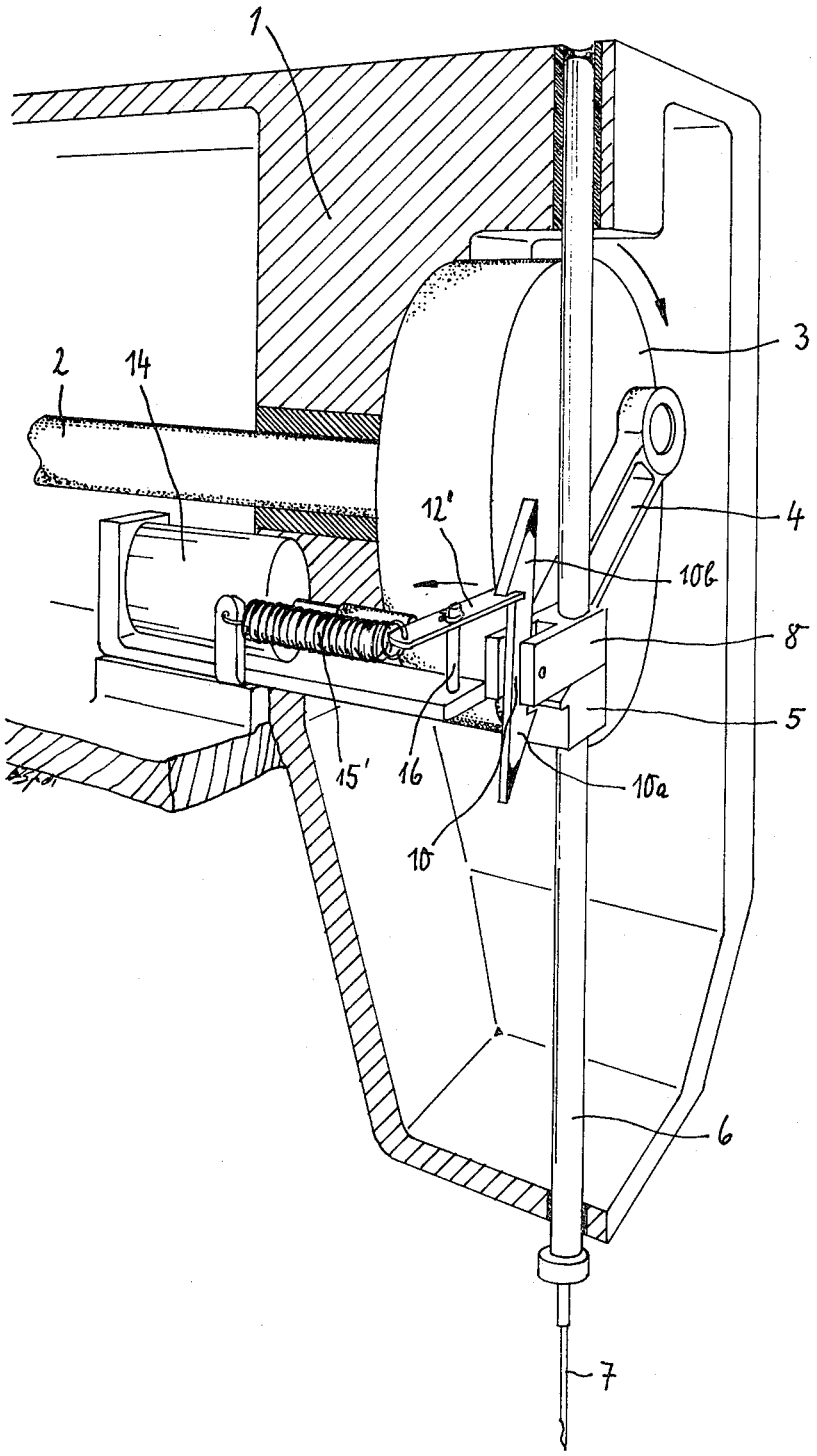
FIG. 6 shows the embodiment of FIG. 5 with the holding pawl in an active position.

In the second embodiment, shown in FIGS. 5 and 6, the holding pawl 12' is swingable about a pin 16 which lies parallel to the plane of motion of the shift pawl 10. In this case also, the holding pawl 12' is acted on by a return spring 15' which acts in the direction opposite that of the actuating element 14 which is developed as a single stroke magnet.

The holding pawl 12' is held in form interlocked manner also by the pin 16, arranged parallel to the plane of motion of the shift pawl 10, against those forces which can be exerted on it by the shift pawl 10. A slight swinging of the holding pawl 12', on the order of magnitude of the thickness of the shift pawl 10, is sufficient to swing it from its active position, located in the plane of motion of the shift pawl 10, into the disengaged position. This disengaged position is shown in exaggerated fashion in FIG. 5, while FIG. 6 shows the active position of the holding pawl 12'. The manner of action of the embodiment of FIGS. 5 and 6 corresponds to the manner of action of the embodiment of FIGS. 1 to 4 which has already been described.

Of course, the embroidery or sewing machine may also have a plurality of needle bars one of which may be optionally coupled to the drive carriage 5 and be held fast in the upper dead-center position by the holding pawl 12 and 12' in the manner described above.

I claim:

1. In a device for temporarily interrupting the movement of an embroidery needle on an automatically controlled embroidery or sewing machine having a housing and at least one needle bar adapted to be driven by a connecting rod and a crank from a drive shaft, on which needle bar there is fastened a driver couplable, by means of a shift pawl formed as a double-armed lever, with a drive carriage pivotally connected to the connecting rod, the shift pawl being movable in a plane of movement by forces on the shift pawl, one arm of the lever cooperating with a catch formed on the drive carriage and respectively the other arm of the lever cooperating by form-interlocking with a holding pawl for holding the needle bar fixed in an upper dead-center position with simultaneous disconnection from the drive carriage, and an actuating means for controlling the holding pawl, the improvement comprising holding means at least partly non-movably connected to the housing for holding by housing holding forces the holding pawl in a form-interlocking engagement against the shift pawl, counter to the forces of the shift pawl such that by the form-interlocking engagement between the holding pawl and the shift pawl, the holding forces are transmitted via the housing and not operatively via the actuating means, said actuating means is for moving the holding pawl at least partly out of the plane of movement of the shift pawl.

2. The device according to claim 1, further comprising means for guiding movement of the holding pawl along a linear path at right angles to the plane of movement of the shift pawl.

3. The device according to claim 2, wherein said guiding means simultaneously is at least part of said holding means.

4. The device according to claim 1, wherein said holding means includes a pin member supporting the holding pawl for swinging movement by said actuating means, said pin being disposed parallel to the plane of movement of the shift pawl and connected to the housing.

5. The device according to claim 4, further comprising a spring which biases said holding pawl into engagement with said lever, said pin and said spring simultaneously constitute at least part of said holding means.

6. The device according to claim 1, wherein the actuating means comprises a single stroke magnet.

7. The device according to claim 1, further comprising means for biasing the shift pawl into engagement with the drive carriage for providing the forces of the shift pawl.

8. The device according to claim 7, wherein said biasing means is a spring.

9. The device according to claim 1, wherein said holding means holds said holding pawl in said form-interlocking engagement such that the forces of said shift pawl are not transmitted operatively to said moving means.

10. The device according to claim 9, wherein said actuating means is exclusively for being actuated only for disengaging said holding pawl from holding said shift pawl by said holding means.

11. The device according to claim 10, further comprising spring means acting on said shift pawl for providing said forces of the shift pawl and via the latter cooperating with said holding pawl for holding said shift pawl in engagement with said holding pawl when said actuating means is not actuated.

12. The device according to claim 1, wherein said actuating means is for moving said holding pawl by a distance substantially equal to the thickness of said shift pawl.

13. The device according to claim 1, wherein said actuating means is for moving said holding pawl in a plane which is perpendicular to said plane of movement of said shift pawl.

14. The device according to claim 1, wherein said actuating means is for moving said holding pawl in a plane which is parallel to said plane of movement of said shift pawl.

15. The device according to claim 1, said holding means is a fixed support.

16. In a device for temporarily interrupting the movement of an embroidery needle on an automatically controlled embroidery or sewing machine having at least one needle bar adapted to be driven by a connecting rod and a crank from a drive shaft, on which needle bar there is fastened a drive couplable, by means of a shift pawl formed as a double-armed lever, with a drive carriage pivotally connected to the connecting rod, the shift pawl being movable in a plane of movement by forces on the shift pawl, one arm of the lever cooperating with a catch formed on the drive carriage and respectively the other arm of the lever cooperating with a controllable holding pawl for holding the needle bar fixed in an upper dead-center position with simultaneous disconnection from the drive carriage, the improvement comprising means for holding the holding pawl in a form interlocked manner against the forces of the shift pawl, means for moving the holding pawl out of the plane of movement of the shift pawl, and a return spring engageable with said holding pawl for normally urging said holding pawl into the plane of movement of the shift pawl, said moving means acting against said return spring.

17. In a device for temporarily interrupting the movement of an embroidery needle on an automatically controlled embroidery or sewing machine having at least one needle bar adapted to be driven by a connecting rod and a crank from a drive shaft, on which needle bar there is fastened a driver couplable, by means of a shift pawl formed as a double-armed lever, with a drive carriage pivotally connected to the connecting rod, the shift pawl being movable in a plane of movement by forces on the shift pawl, one arm of the lever cooperating with a catch formed on the drive carriage and respectively the other arm of the lever cooperating with a controllable holding pawl for holding the needle bar fixed in an upper dead-center position with simultaneous disconnection from the drive carriage, the improvement comprising means for holding the holding pawl in a form interlocked manner against the forces of the shift pawl, means for moving the holding pawl out of the plane of movement of the shift pawl, means for guiding movement of the holding pawl along a linear path at right angles to the plane of movement of the shift pawl, said holding means includes two parallel linear guide members, said holding pawl being slidably held therebetween.

* * * * *